US009574349B2

(12) United States Patent
Subacchi

(10) Patent No.: US 9,574,349 B2
(45) Date of Patent: Feb. 21, 2017

(54) POST-TENSIONING CONCRETE PIPE WRAP

(71) Applicant: Hawkeye Concrete Products Co., Mediapolis, IA (US)

(72) Inventor: Claudio Subacchi, Mediapolis, IA (US)

(73) Assignee: Hawkeye Pedershaab Concrete Technologies, Inc., Mediapolis, IA (US)

( * ) Notice: Subject to any disclaimer, the term of this patent is extended or adjusted under 35 U.S.C. 154(b) by 0 days.

(21) Appl. No.: 14/270,788

(22) Filed: May 6, 2014

(65) Prior Publication Data

US 2014/0331580 A1 Nov. 13, 2014

Related U.S. Application Data

(60) Provisional application No. 61/822,548, filed on May 13, 2013.

(51) Int. Cl.

| | |
|---|---|
| ***E04C 5/08*** | (2006.01) |
| *E01D 19/14* | (2006.01) |
| *E04C 3/34* | (2006.01) |

(52) U.S. Cl.

CPC ..... *E04C 5/08* (2013.01); *E01D 19/14* (2013.01); *E04C 3/34* (2013.01); *E04C 5/085* (2013.01)

(58) Field of Classification Search

CPC ..... E04C 5/08; E04C 5/12; B28B 21/62; B28B 23/18; B29C 70/547; B29C 70/56; F16L 9/086

USPC ..... 52/2.15, 223.14; 138/176

See application file for complete search history.

(56) References Cited

U.S. PATENT DOCUMENTS 1,412,096 A * 4/1922 Von Emperger ..... E04C 3/293 52/223.5
2,048,253 A * 7/1936 Freyssinet ..... 264/71
2,929,236 A * 3/1960 Steward ..... E04B 1/06 52/223.3
3,237,358 A * 3/1966 Harris ..... E04H 7/20 52/223.2
3,260,020 A * 7/1966 Patin ..... 52/2.15
3,489,626 A * 1/1970 Rubenstein ..... 156/86
RE27,061 E 2/1971 Rubenstein
3,630,237 A * 12/1971 Varnell et al. ..... 138/176
3,742,985 A * 7/1973 Rubenstein ..... 138/141
3,810,337 A * 5/1974 Pollard ..... 52/223.8
4,032,402 A * 6/1977 Horner ..... G21C 1/328 376/295
4,043,133 A * 8/1977 Yegge ..... E02D 5/58 405/239
4,044,088 A * 8/1977 Hume ..... B28B 21/62 138/176
4,153,656 A * 5/1979 Bunyan ..... 264/40.1
4,771,530 A * 9/1988 Creedon ..... 29/421.1
5,043,033 A * 8/1991 Fyfe ..... B29C 70/56 156/161
5,328,656 A * 7/1994 Thulin ..... 264/571
5,339,574 A * 8/1994 Downing ..... 52/2.15

(Continued)

*Primary Examiner* — Joshua J Michener
*Assistant Examiner* — Alp Akbasli
(74) *Attorney, Agent, or Firm* — Shuttleworth & Ingersoll, PLC; Jason Sytsma

(57) ABSTRACT

A post-tensioning wrap includes a housing having at least one cavity and at least one tendon bonded to the housing. The wrap can be wrapped around the concrete article to equalize compression. Thereafter, a medium is injected into the cavity causing the housing to swell and compression of the concrete article by the tendon.

13 Claims, 1 Drawing Sheet

(56) References Cited

U.S. PATENT DOCUMENTS 5,552,197 A * 9/1996 Bettinger ..... 428/34.9
5,671,572 A * 9/1997 Siller-Franco ..... 52/223.8
5,721,034 A * 2/1998 Seemann et al. ..... 428/71
5,911,446 A * 6/1999 McLennan ..... F16L 21/08 285/104
5,939,003 A * 8/1999 Crigler et al. ..... 264/228
6,052,962 A * 4/2000 Ghali et al. ..... 52/851
6,123,485 A * 9/2000 Mirmiran et al. ..... 405/252
6,126,206 A * 10/2000 Topf, Jr. ..... F16L 21/005 138/97
6,629,547 B1 * 10/2003 Yamaguchi ..... B29C 66/73921 138/125
6,942,915 B1 * 9/2005 Kondo et al. ..... 428/174
7,426,942 B2 * 9/2008 Rice ..... F16L 55/175 138/97
7,503,249 B2 * 3/2009 Jackson et al. ..... 89/8
7,811,495 B2 * 10/2010 Dagher et al. ..... 264/228
8,052,174 B2 * 11/2011 Sharma ..... F16L 21/022 285/124.1
8,388,785 B2 * 3/2013 De Jong ..... B29C 53/581 156/195
8,490,337 B2 * 7/2013 Word, III ..... E04H 12/085 52/40
8,511,013 B2 * 8/2013 Voss ..... E04C 5/07 52/223.5
8,522,486 B2 * 9/2013 Dagher et al. ..... 52/2.15
8,550,823 B2 * 10/2013 Menardo ..... F03B 13/188 439/4
8,591,788 B2 * 11/2013 Dagher et al. ..... 264/228
8,720,907 B2 * 5/2014 Worley ..... F16L 5/10 24/279
8,795,832 B2 * 8/2014 Fyfe et al. ..... 428/379
9,194,516 B2 * 11/2015 Beagen, Jr. ..... F16L 23/04
2002/0124502 A1 * 9/2002 Henderson ..... E02D 27/42 52/296
2003/0151249 A1 * 8/2003 Topf, Jr. ..... F16L 21/002 285/55
2004/0131428 A1 * 7/2004 Henderson ..... E02D 27/42 405/233
2005/0092944 A1 * 5/2005 Patterson ..... F16K 7/08 251/4
2005/0131279 A1 * 6/2005 Boulais ..... A61B 1/00059 600/141
2006/0174549 A1 * 8/2006 Dagher et al. ..... 52/86
2007/0175577 A1 * 8/2007 Dagher et al. ..... 156/229
2008/0209842 A1 * 9/2008 Montaner Fraguet .. E04H 12/12 52/651.07
2009/0171436 A1 * 7/2009 Casanova ..... A61L 31/18 623/1.13
2010/0286791 A1 * 11/2010 Goldsmith ..... A61B 17/12022 623/23.7
2011/0011008 A1 * 1/2011 Dagher et al. ..... 52/2.15
2011/0037257 A1 * 2/2011 Walker ..... E21B 17/01 285/337
2011/0239564 A1 * 10/2011 Zheng ..... B29C 70/086 52/231
2012/0058338 A1 * 3/2012 Fyfe ..... D07B 1/00 428/365
2013/0255169 A1 * 10/2013 Henderson ..... E04C 5/125 52/223.13
2014/0163664 A1 * 6/2014 Goldsmith ..... A61B 17/00491 623/1.11
2014/0255106 A1 * 9/2014 Henderson ..... E02D 27/12 405/256

* cited by examiner

POST-TENSIONING CONCRETE PIPE WRAP

This application claims priority to U.S. Provisional Patent Application 61/822,548 filed May 13, 2013, the contents of which are hereby incorporated by reference herein.

Prestressed concrete plays a significant role in many of the building structures in use today. Prominent applications of prestressed concrete include: bridges, building columns, pressure cylinders, liquid storage tanks, and cylinders. Common to each of these applications, is the goal of eliminating tension forces in concrete load-bearing members, since concrete is notably weak in tension, but is strong in compression. In each of these applications, a prestressing force, applied prior to the concrete being loaded through use, is generated by stretching steel reinforcing members or tendons positioned internal to the concrete member. The stretched reinforcing members exert a compressive force on the concrete, which is arranged (in any one of several different ways) to prevent their relaxing.

Prestressing is commonly accomplished in one of two ways: pretensioning or post-tensioning, and may be applied either to pre-cast members manufactured off site, or may be done in the field, at the point of use of the concrete member. In pretensioning, stretched tendons are mechanically bonded to the concrete while the concrete is being cured. In the post-tensioning method, however, reinforcing members are prevented from being bonded to the concrete, thereby allowing the members to be stretched after the concrete is cured. Axially extending tendons are typically encased in sheaths to prevent bonding of the tendons to the concrete. When the concrete has been cured to a predetermined minimum strength, hydraulic jacks tension the tendons by working against the ends of the beam, thereby putting the beam in compression. An alternative technique, not requiring manual stretching of tendons, could provide significant economic and safety-related advantages.

SUMMARY

A post-tensioning wrap for a concrete article includes a housing having at least one cavity and at least one tendon bonded to the housing. The wrap can be wrapped around the concrete article. Thereafter, a medium is injected into the cavity causing the housing to swell and compression of the concrete article by the tendon. In another embodiment, the housing has a plurality of cavities and a plurality of tendons each made from steel or a high tensile strength material with an elasticity modulus greater than or equal to the concrete in the concrete article.

More specifically, the tendon has a first end and a second end that corresponds with the housing that has a first end and a second end. The first end of the tendon extends beyond the first end of the housing and the second end of the tendon extends beyond the second end of the housing. A first clamp attached to the first end of the tendon and a second clamp attached to the second end of the tendon holds the tendon in place causing it to stretch and compress the concrete article.

In another embodiment, a method for making a prestressed concrete article is disclosed. A housing with at least one cavity and at least one tendon is wrapped around the concrete article. The tendons are clamped into place. The cavity is filled with a medium causing the housing to swell and compression of the concrete article by the tendon.

DETAILED DESCRIPTION OF THE ILLUSTRATED EMBODIMENT

Figure 1:
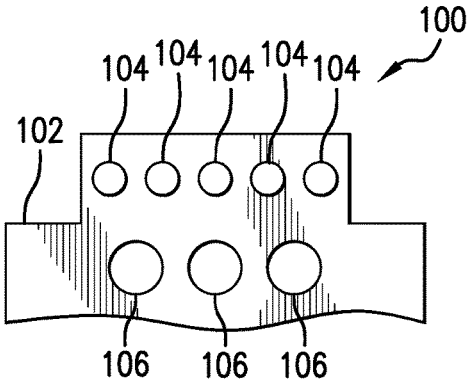
FIG. 1 is a front view of a post-tensioning wrap according to an embodiment of the invention.
Figure 2:
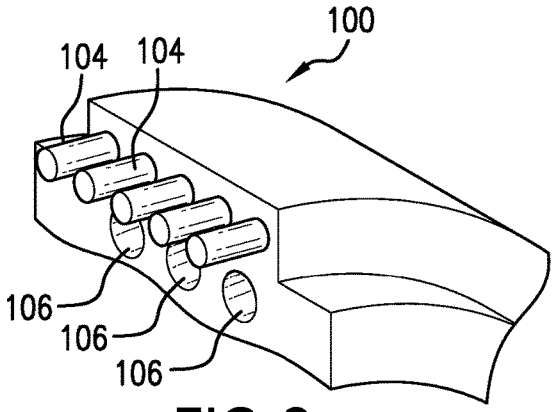
FIG. 2 is a perspective view of the post-tensioning wrap of FIG. 1.
Figure 3:
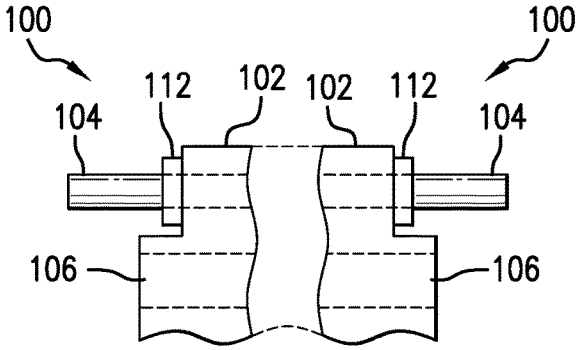
FIG. 3 is a side view of the post-tensioning wrap of FIG. 1.

FIGS. 1-3 show a front, perspective, and side view of a post-tensioning wrap 100 according to an embodiment for making a pre-stressed concrete article. Post-tensioning wrap 100 includes a plastic housing 102 molded to at least one tendon 104. At least one cavity 106 is formed in housing 102 to receive a semi-viscous medium. The medium causes housing 102 to swell with the load being carried by tendons 104.

Figure 4:
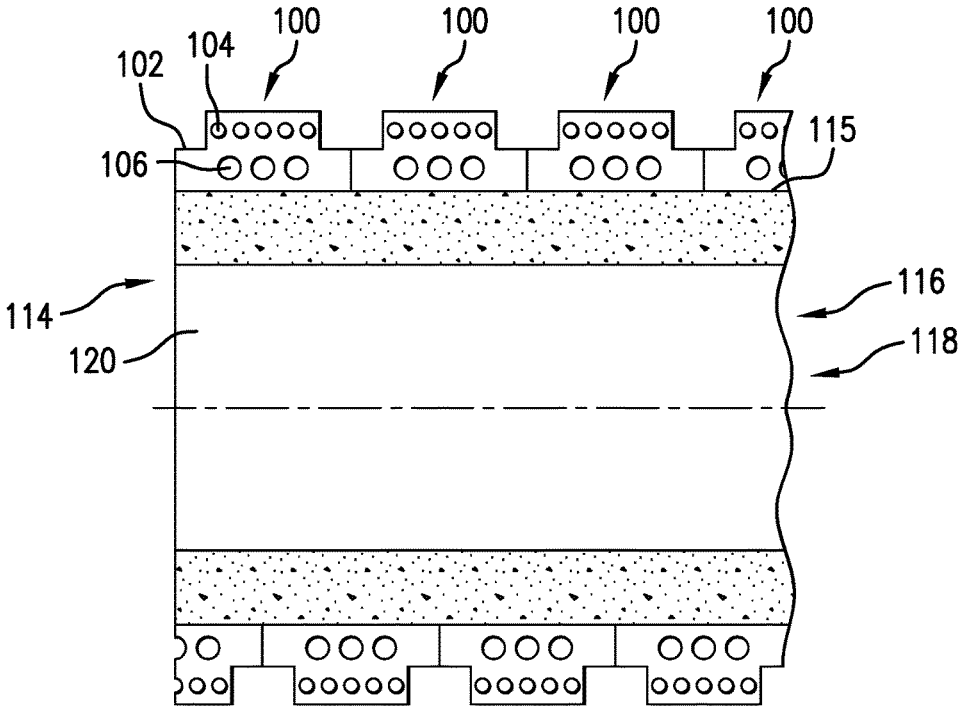
FIG. 4 is a concrete culvert wrapped with the post-tensioning wrap of FIG. 1.

A concrete cylinder 108 is shown in FIG. 4. Cylinder 108 has a first end 114 and a second end 116 bounded by an external surface 115, and an inner bore 118 defined by an inner wall 120. Cylinder 108 can include interior steel members for reinforcement, but to save cost, the steel reinforcement members can be omitted. Cylinder 108 is fabricated using known techniques, and does not require any special processing, such as pressurizing or otherwise treating the concrete material as it hardens. The present disclosure is not limited to prestressing cylinder 108, but encompasses any concrete article that can benefit from prestressing, such as culverts of any shape or size, columns, enclosures, tanks, rigid members, etc.

Cylinder 108 is spirally wrapped either before or after curing with post-tensioning wrap 100. Wrap 100 is a single continuous wrap that is wrapped around cylinder 108. When done before curing, cylinder 108 can be cast inside a jacket that includes post-tensioning wrap 100, so that housing 102 is bonded to the outer-diameter of cylinder 108 as it cures; otherwise, post-tensioning wrap is wrapped around the outer surface of cylinder 108.

Once cylinder 108 is wrapped with post-tensioning wrap 100, each tendon 104 is anchored to housing 102 at each end of cylinder 108. The tendons can be made of high-strength steel which can satisfactorily maintain high working stresses, typically ranging between 150,000 and 180,000 pounds per square inch. The anchoring can be done in any manner known to those skilled in the art, such as with a clamp 112, as shown in FIG. 3, at each end of the tendon.

After tendons 104 are clamped to housing 102, the semi-viscous medium is injected into cavities 106 of post-tensioning wrap 100. Housing 102 swells from the medium, but the ends of tendons 104 are anchored to opposing ends of housing 102, which causes tendons 104 to stretch. The stretching of tendons 104 applies a compression force around cylinder 108.

Having described the general function of post-tensioning wrap 100, the specific elements are described in more detail.

Housing 102 is an injection molded plastic housing that is formed rigid enough to provide adequate retention of the pressurizing force without further, undesired swelling, which would detract from that force. Housing 102 can also be made from a low permeable material that shields tendons 104 from chemicals that might cause corrosion. In practice, the amount of swelling and the strength of housing 102 are well-defined using known principles to provide an accurate indication of the pressurization forces applied to cylinder 108.

Housing 102 is further injection molded around tendons 104 so that tendons 104 are bonded to housing 102. Tendons 104 can be made of any material suitable for withstanding the tensioning necessary to apply the necessary compression force to cylinder 108. Tendons 104 can be made from steel or any other fibrous or high tensile strength material with an elasticity modulus greater than or equal to the concrete; for example, tendons 104 could be made from fiber glass. The number of tendons 104 bonded to housing 102 is not intended to be limiting.

As previously stated, a semi-viscous medium is injected into cavities 106. Thereafter, the medium hardens or cures into a solid or other form which maintains the injection pressure with very little or no risk of leaking from the ends of cavity 106. More specifically, the medium can be a pressurized liquid or a high pressure medium comprising a grout of either plastic, epoxy resin or cementitious material, which is fluidically injected in cavity 106 and is thereafter allowed to cure or harden into a solid form. As used herein, the terms "cement" or "cementitious materials," as applied to the pressurized medium refer to hydraulic cements and the like, which typically include calcium (e.g., calcium oxide and calcium sulfate), silicon (e.g., silicon oxide) and other similar elements, and are usable for making Portland Cement, concretes, mortars (including stuccos and plasters, such as Plaster of Paris), grouts, and other like materials. More specifically, these terms are not intended to include adhesives commonly referred to as "cements," such as vinyl cement, plastic cement, rubber cement or the like which are used to bond vinyl, plastic, rubber and other components.

Pressure distributions according to the invention have improved uniformity, and pressure levels are easily controlled and measured, especially when swelling of the outer casing is monitored, as discussed above. It can be seen, therefore, that the prestressed concrete arrangement of the present invention provides uniform pressurizing of the outer surfaces of the prestressed concrete members. Further, the prestressing is accomplished with a single easily fabricated wrap. There is no need to apply a second coat of concrete to protect tendons 104 because tendons 104 are protected by housing 102. There is no need to post-tension tendons 104 with a separate machine, because the post-tensioning is applied by virtue of the expansion of housing 102 from the mortar. Finally, the post-tensioning method herein described is easier to carry out with less people resulting in significant time and cost savings.

Post-tensioning wrap 100 can be spirally wrapped around cylinder 114 with housing 102 positioned contiguously next to each other around cylinder 114, as shown in FIG. 4. A space 105 between each housing 102 can receive a weld to combine housing 102 to each other or some other low permeable barrier to the concrete to minimize chemical reactions with the soil that may have high or low pH or sulfates.

Reference has been made throughout this disclosure to "one embodiment," "an embodiment," or "embodiments" meaning that a particular described feature, structure, or characteristic is included in at least one embodiment of the present invention. Thus, usage of such phrases may refer to more than just one embodiment. Furthermore, the described features, structures, or characteristics may be combined in any suitable manner in one or more embodiments.

While the present invention has been particularly shown and described with reference to exemplary embodiments thereof, it should be understood by those of ordinary skill in the art that various changes, substitutions and alterations could be made herein without departing from the spirit and scope of the invention as embodied by the appended claims and their equivalents.

What is claimed is:

1. A post-tensioning wrap for a concrete article, comprising:

a housing comprising a mass of material and comprising at least one cavity within and surrounded around its circumference by the housing extending a longitudinal length of the housing;

at least one tendon substantially surrounded by the housing and parallel to the cavity and extending the longitudinal length of the housing; and wherein the post-tensioning wrap is configured to be spirally wrapped around the concrete article and the at least one tendon extends circumferentially around the concrete article, and thereafter, the post-tensioning wrap is operable to have a medium injected into the cavity and flow circumferentially around the concrete article causing the housing to swell and causing compression of the concrete article by the tendon.

2. The post-tensioning wrap of claim 1, and further comprising a plurality of cavities.

3. The post-tensioning wrap of claim 1, and further comprising a plurality of tendons, wherein the plurality of tendons are positioned radially away from the concrete article and the at least one cavity.

4. The post-tensioning wrap of claim 1, wherein the tendon is steel.

5. The post-tensioning wrap of claim 1, and wherein the tendon has a first end and a second end, and the housing has a first end and a second end, wherein the first end of the tendon extends beyond the first end of the housing and the second end of the tendon extends beyond the second end of the housing, and the post-tensioning wrap further comprises a first clamp attached to the first end of the tendon and a second clamp attached to the second end of the tendon to cause the tendon to stretch and compress the concrete article.

6. The post-tensioning wrap of claim 5, wherein the post-tensioning wrap is configured to equalize and provide uniform compression around the concrete article.

7. A post-tensioning wrap for a concrete article, comprising:

a housing including a front face and a back face separated from the front face by a longitudinal length of the housing, a least one cavity extending from the front face to the back face and surrounded around its circumference by the housing, wherein the cavity is operable to receive a medium for causing the housing to swell, the housing further including a step on each side of the housing;

at least one tendon extending from the front face of the housing parallel with the cavity to the back face of the housing, wherein the at least one tendon is combined to the housing and operable to compress the concrete article; and wherein the post-tensioning wrap is configured to be spirally wrapped around the concrete article with a space between each contiguous position of the housing formed by the step on each side of the housing, the space is configured to receive a low permeable seal to combine each contiguous position of the housing.

8. The post-tensioning wrap of claim 7, and further comprising a plurality of cavities configured to extend circumferentially around the concrete article so that the medium flows circumferentially around the concrete article.

9. The post-tensioning wrap of claim 7, and further comprising a plurality of tendons configured to extend circumferentially around the concrete article, wherein the plurality of tendons are positioned radially away from the concrete article and the at least one cavity.

10. The post-tensioning wrap of claim 7, wherein the tendon is one chosen from steel and a high tensile strength material with an elasticity greater than or equal to concrete.

11. The post-tensioning wrap of claim 7, and wherein the tendon has a first end and a second end, and the housing has a first end and a second end, wherein the first end of the tendon extends beyond the first end of the housing and the second end of the tendon extends beyond the second end of the housing, and the post-tensioning wrap further comprises a first clamp attached to the first end of the tendon and a second clamp attached to the second end of the tendon to cause the tendon to stretch and compress the concrete article.

12. The post-tensioning wrap of claim 11, wherein the post-tensioning wrap is configured to be spirally wrapped around the concrete article to equalize compression around the concrete article.

13. The post-tensioning wrap of claim 7, wherein the housing is made from a low permeable material to protect the tendon.

* * * * *